United States Patent [19]

Lucas

[11] 3,969,233

[45] July 13, 1976

[54] BIODEGRADABLE INTERNAL COMBUSTION ENGINE LUBRICANTS AND MOTOR FUEL COMPOSITIONS

[76] Inventor: William J. Lucas, Ridge Road, R.R. No. 1, Birmingham, Mich. 49436

[22] Filed: Aug. 23, 1974

[21] Appl. No.: 499,902

Related U.S. Application Data

[63] Continuation-in-part of Ser. No. 188,518, Oct. 12, 1971, abandoned, and a continuation-in-part of Ser. No. 38,547, May 26, 1970, abandoned.

[52] U.S. Cl. ..... 252/22; 44/58; 252/29; 252/34; 252/34.7; 252/37.2; 252/49.3; 252/49.5

[51] Int. Cl.[2] ..... C10M 3/18

[58] Field of Search ..... 252/22, 29, 34, 34.7, 252/37.2, 42.1, 49.3, 49.5; 44/58

[56] References Cited

UNITED STATES PATENTS

| | | | |
|---|---|---|---|
| 1,990,365 | 2/1935 | Beale | 252/34.7 X |
| 2,560,542 | 7/1951 | Bartleson | 252/35 X |
| 2,780,598 | 2/1957 | Cafcas | 252/42.1 X |
| 3,213,024 | 10/1965 | Blake et al. | 252/33.3 |
| 3,448,787 | 6/1969 | Beers | 252/49.5 |
| 3,495,962 | 2/1970 | Norton et al. | 252/29 X |
| 3,507,791 | 4/1970 | Teeter et al. | 252/49.3 X |
| 3,507,792 | 4/1970 | Zuraw | 252/49.5 |
| 3,630,898 | 12/1971 | Teeter et al. | 252/49.3 X |
| 3,634,245 | 1/1972 | Meisters | 252/49.3 |

*Primary Examiner*—Delbert E. Gantz
*Assistant Examiner*—Andrew H. Metz
*Attorney, Agent, or Firm*—Sol B. Wiczer

[57] ABSTRACT

Lubricant for internal combustion engines comprising lubricating oil components including dispersing substances so that water insoluble components of the lubricant may be dispersed in the water so that no visible oil slick will remain.

22 Claims, No Drawings

BIODEGRADABLE INTERNAL COMBUSTION ENGINE LUBRICANTS AND MOTOR FUEL COMPOSITIONS

This invention is a continuation-in-part of my co-pending application Ser. No. 188,518, filed Oct. 12, 1971 now abandoned, and in turn a continuation-in-part of my co-pending application Ser. No. 38,547, filed May 26, 1970, now abandoned, and relates to a biodegradable lubricant component for internal combustion engines dispersible in both oil and water.

The emulsifiable biodegradable lubricant component is so designated because it is operative per se as a lubricant either for top cylinder lubrication or as a crankcase or transmission lubricant with or without further dilution with water or mineral lubricating oil; but is miscible or emulsifiable with either. Consequently, my lubricant may be homogeneously mixed either with water or mineral oil which it is miscible or emulsifiable.

My lubricant component is also miscible or dispersible in gasoline and, consequently, with or without further inclusion of mineral oil may be used as an upper lubricant dispersed in gasoline. It is also useful alone as a crankcase or transmission lubricant or with further dilution with water or mineral oil in which it is suspendable or dispersible; and, in each case, the composition upon ultimate disposal may be mixed with water in which it is biodegradable.

The lubricant hereof contains as essential components soaps or interactable components to form soaps, and polyoxyethylene esters or ethers either of fatty, napthenic or rosin acids, and of polyhydric alcohols. These products are blended with each other for desired lubricating function and ultimate biodegradability with either water or mineral oil dispersibility and are outstanding for such purposes. They are present in the composition in quantity to function as a good lubricant and preferably are proportioned for such purposes to the other components to render the product emulsifiable or soluble either in water or oil whereby the product hereof can optionally have moderate amounts of oil and water added thereto to form a stable liquid dispersion of both or either.

Thus the emulsifying components are generally present in quantity to allow a dispersion or solution of one part of lubricant component to form 10 to 250 parts of gasoline as upper lubricant for a two-cycle engine; and from one part of lubricant to 1000 to 100,000 parts of gasoline in a four-cycle engine. Such use of a composition in gasoline is as an upper cylinder lubricant identified herein as a Type I composition. In the Type I composition the product further contains a small quantity of a volatile solvent such as a lower alcohol or ketone which enhances its fluidity for handling as a liquid and allows stable solution in large quantities of gasoline.

On the other hand, where the composition is to be used as a crankcase or transmission lubricant, identified as a Type II composition, and is to be blended with a mineral lubricating oil for enhancing the lubricating function, it is useful to blend it in proportion of about one part of lubricant component per part of mineral oil up to one part of lubricant component to one hundred parts of mineral oil. Such lubricant is useful for lubricating two and four-cycle gears and transmissions as well as four-cycle crankcases. The Type II composition hereof may be used alone without further addition either of water or oil for lubrication of either two and four-cycle gears and transmissions or four-cycle crankcase lubrication.

The components of a Type I composition are listed as follows:

a. A lower alkanol such as methyl, propyl, isopropyl alcohol, glycerol or glycol, generally having about 1 to 4 carbon atoms; or a lower ketone such as acetone. This component is used primarily as a diluent and gasoline blending agent, and is used in quantity whereby the total lubricant component can be handled as a fluid. It will also enhance the solubility of the lubricant components in water, gasoline and mineral oil.

b. Fatty and higher mono and di-basic acids, naphthenic and rosin acids usually having about 6 to 30 carbon atoms. Typical examples of such acids are oleic, linoleic, ricinoleic, tall oil, linolenic, naphthenic, lauric, palmitic, abietic, octanoic, caproic and azeloic, of which the unsaturated and tall oil fatty acids are preferred.

c. Lower primary, secondary and tertiary amines and alkanol amines in which the alkyl or alkylene group has 1 to 6 carbon atoms which may be cyclic to include benzene or cyclohexane and the like. Typical examples are diethylamine, diethanolamine, triethanolamine, cyclohexylamine, aniline, triethylamine and the like. Both fatty acids and amines are independently active emulsifiers, but will react with each other to form amine soaps and with variation in proportions in the ranges stated there may be and usually will be free fatty acids or free amine remaining in the composition after the reaction. These amine soaps formed in situ, will be recognized to be combustible in the engine without leaving a residue while performing an emulsifying function in the liquid phase.

d. Polyoxyethylene carboxylic acid esters in which the polyoxyethylene chain may have from 10 to 60 oxyethylene groups and in which the carboxylic acid may be any of the acids as listed above in paragraph (b). Typical examples are naphthenic, ricinoleic, palmitic, oleic, caproic, linoleic, abietic and tall oil esters of polyethyleneoxy ethanols, having 15, 25 or 35 ethyleneoxy groups.

e. A polyoxyethylene ether of a polyhydric sugar derived aliphatic alcohol of 5 to 6 carbon atoms having 5 or 6 hydroxy groups or their sugar polymers including sugar acids, and which may be further esterfied with a sugar carboxylic acid acyl of an acid as defined in paragraph (b) above. Typical examples are dipolyethyleneoxy groups as ethers of two sucrose hydroxyls, each polyethyleneoxy radical has 20 ethyleneoxy groups; triethyleneoxy sorbitol in which each ethyleneoxy radical has 15 ethyleneoxy groups.

Polyoxyethylene ester of glucuronic acid in which there are 30 ethyleneoxy groups attaching to the carboxy radical through the terminal ethanol group; dipolyethyleneoxy glucuronate in which both of the polyethyleneoxy radicals contain 20 ethyleneoxy groups, one polyethyleneoxy attaching to a hydroxy radical of the sugar acid as an ether and the other attaching to the carboxy radical as an ester; monopolyethyleneoxy glucuronate in which the terminal ethanol radical attaches as an ester to the carboxy group and the polyethyleneoxy radical contains 32 ethyleneoxy groups. Other examples are mixed polyethyleneoxy ethers and esters of a sugar alcohol in which one or more polyethyleneoxy groups attach to hydroxy as ethers and one or more higher carboxylic acyl groups derived from an acid as defined in paragraph (b) above attach to other hydroxy group as esters. Typical examples of such mixed ether and ester compounds are monopolyethyleneoxy, sorbitol dioleate in which the polyethyleneoxy pentaoleate in which the ethyleneoxy radical has 35 ethyleneoxy groups. Typical examples of simple ethers of such polyhydroxy sugar compounds are dipolyethyleneoxy sorbitol in which each of the ethyleneoxy radicals contain 25 ethyleneoxy groups; tripolyethyleneoxy sucrose in which each ethyleneoxy radical contains 15 ethyleneoxy groups; and other such surface-active agents commonly known in the art as spans and tweens. The surface-active agents of paragraph (d) and (e) are present in combined quantity of at least 1% and preferably, in combination with the soaps formed, are sufficient to render the composition easily dispersible in oil and water.

Optional components of a Type I composition are listed as follows:

f. Water, typically relatively pure water such as distilled or deionized water may be added to the composition to improve the cool and clean burning characteristics of the fuel.

g. Common lubricant additives such as colloidal graphite such as micronite dispersed in water or oil and the like.

h. Simple esters of sugars typically a sugar as defined in paragraph (e) combined as an ester with a higher carboxylic acid acyl as defined in paragraph (b); a typical example is sorbitol trioleate.

The components thus given are primarily used as upper lubricants for addition to gasoline with or without addition of other additives such as from 1 to 100 parts of lubricating oil per part of lubricant component described.

The following table lists the components of my Type I upper lubricant composition in approximate proportions:

TABLE I

| Type I Components | Useful Range* | Preferred Range* |
|---|---|---|
| Lower primary, secondary or tertiary alcohols e.g. isopropyl alcohol, ethyl alcohol, propyl alcohol, etc. lower alkyl ketones, such as acetone or methyl ethyl ketone, lower polyhydric alkanols such as glycerols and glycols having 1 to 4 carbon atoms as defined in paragraph (a) above. | 20–75% | 30–60% |
| High molecular weight carboxylic acids such as fatty acids, rosin acids or naphthenic acids comprising the general formula $C_nH_{2n}O_2$ having 6 to 30 carbon atoms as defined in paragraph (b) above.** | 10–50% | 20–40% |
| Primary, secondary and tertiary alkyl and alkanol amines and hydrocarbyl monocarbocyclic amines having 5 to 6 carbon atoms as defined in paragraph (c) above.** | 3–25% | 7–20% |
| Polyoxyethylene fatty acid esters and/or ethers as defined in paragraph (d) above. | 0.5–25% | 1–20% |
| Polyoxyethylene, polyhydroxy aliphatic alcohol derived from sugars and their carboxylic acid esters as defined in paragraph (e) above. | 0.5–25% | 1–20% |

TABLE I-continued

*The quantities given are in weight per cent.
**The acids and amines interact to form an amine soap..

The components as given in the table above, are the essential components of the Type I composition. Other typical additives for a lubricant may be included for enhanced detergency, lubricity, improvement of the viscosity index and for cool operation of the engine.

| | | |
|---|---|---|
| Water | 0.1–40% | 5–25% |
| Graphite micronized in water or oil | .0001–1% | .001–0.5% |
| Polyalkylene glycol preferably having 100 to 500 polyalkyleneoxy groups and derivatives having a viscosity in the range of 250 to 5000 SSU at 100°F | 0.5–60% | 1–40% |
| Non-drying glyceride oils such as castor oil, glyceryl oleate with $I_2$ values or number below 120. | 0.5–20% | 1–20% |
| Sugar esters such as sorbitol trioleate. | 0.5–20% | 1–20% |

In forming the Type I composition each of the essential compounds in the quantity selected with the range given are blended together to form the liquid lubricant. It can have other optional components included. For use in a motor fuel it will be diluted by the gasoline in the quantities given.

It will be noted that the Type I compounds for upper cylinder lubrication blended with up to 100 parts of a mineral lubricating oil, typically a naphthenic based oil such as a coastal oil, having a viscosity in the range of 50 to 1,000 SSU at 100°F, more usually in the range of 150 to 600 SSU at 100°F. Each of the Type I lubricating compositions as stated as infinitely miscible or suspendable as an emulsion with mineral oils on the one hand and are at least suspendable in indefinite quantity with the water on the other, the emulsifying soap and polyalkyleneoxy components always being present in quantity sufficient to emulsify the total composition.

In the above composition it will be noted that the amine component may be present in quantity less than sufficient to provide a substantial amine soap component; or there may be provided more than needed to fully neutralize the organic acid component; or may be present in quantity to neutralize only a portion of such acids, whereby the soaps become freely water soluble per se as the amine salt. The carboxylic acids in the lower quantity range, such as less than 20%, are formed into amine soap and are soluble in water per se; and, in the higher quantity range, according to the above formulation, are dispersible in water as an emulsion with the aid of the surfactants including such soaps. Moreover, additional solubilizing effect is present in the polyoxyalkylene ester or ether components. Consequently, the term "suspendable" as used herein is intended generically to refer to the property of forming a stable suspension of the total composition in water, mineral oil or gasoline, either as an emulsion or as a solution therein.

Consequently, as to the Type I composition, it will be noted that it contains no high melting soaps; and in the presence of the alcohol in the quantity used is usually liquid. The total composition itself may be handled as a liquid. After combustion any residues appearing in the exhaust are light powderly solids that do not tend to remain coated on any parts of the engine or exhaust.

A type II composition used for gear, transmission and crankcase lubrication will consist of:

a. alkali metal such as sodium or potassium, alkali earth metal such as calcium, or ammonium and lower primary, secondary or tertiary alkylamine, alkanolamine and monocarbocyclic amines having 1 to 6 carbon atoms in the form of a soap such as a soap of one of the acids listed in group (b);

b. higher carboxylic acids having 6 to 30 carbon atoms as defined for the Type I composition in paragraph (b) above, such as saturated and unsaturated fatty acids, rosin acid, naphthenic acids and tall oil acids;

c. free lower primary, secondary or tertiary amines, or alkanol amines having 1 to 6 carbon atoms or monocarbocyclic amines as defined for Type I composition in paragraph (c) above or combined as soaps with acids as in (b);

d. polyoxyethylene carboxylic acid esters in which the polyoxyethylene chain may have from 10 to 60 oxyethylene groups and in which the carboxylic acid may be any of the acids as listed above in paragrah (b). Typical examples are naphthenic, ricinoleic, palmitic, oleic, caproic, linoleic, abietic and tall oil esters of polyethyleneoxy ethanols, having 15, 25 or 35 ethyleneoxy groups.

e. organo metallic salts of heavy metals with a drying oil acid such as a highly unsaturated fatty acid, or tall oil typically linoleic, naphthenic or rosin acids, and metals as listed in part (d) of the table of the Type II components below; and f. polyoxyethylene esters or ethers of polyhydric alcohols such as sorbitol, sugars or sugar acids such as the Type I component listed in paragraph (e) above.

In group (a) the soaps are of higher fatty acid, tall oil, rosin or naphthenic acids and other acids listed below, typically of alkali, alkali earth metal or amine such as sodium, potassium, calcium or a primary, secondary or tertiary alkyl or alkanol amine in which the alkyl or alkanol groups have 1 to 6 carbon atoms and which may be cyclic to include benzene or cyclohexane or the like, whereby the amine components of the soap may be diethylamine, trimethylamine, triethylamine, diethanolamine, triethanolamine, cyclohexylamine, aniline and the like. The fatty acid components may be mono and di-basic and have 6 to 30 carbon atoms and typically may be oleic, octanoic, caproic, azeloic and mixtures such as tall oil fatty acids. The amine of the amine soap is derived at least in part from the amine listed in paragraph (b) below. Typical soaps are potassium oleate, sodium abietate, calcium stearate, sodium naphthenate, diethanolamine, linoleate, cyclohexylamine caproate, diethylamine abietate and the like.

In group (c) lower primary, secondary or tertiary alkylamines and alkanolamines in which the alkyl or alkanol group has 1 to 6 carbon atoms are, for instance, trimethylamine, diethanolamine, diethylamine and triethanolamine which may be cyclic to include aniline or cyclohexylamine and the like as described In groups (b) and (e) the carboxylic acids as typical examples are rosin acids, drying oil acids, tall oil acids, and naphthenic acid, ricinoleic, linoleic, linolenic, abietic, lauric, octanoic, caproic, azeloic and the like.

The following table lists the Type II components in the quantity ranges as they will be used:

| Type II Components | | Useful Range* | Preferred Range* |
|---|---|---|---|
| (a) | alkali salts of saturated and unsaturated fatty acids and rosin acids and/or naphthenic acids such as sodium, potassium, calcium, primary, secondary, tertiary, cyclic amine salts such as resinate, oleate, linoleate, linolenate, stearate, caprylate | 5–75% | 10–60% |
| (b) | Class of compounds known as basic amines, i.e. primay, secondary, tertiary or cyclic or mixtures thereof as in paragraph (c) above; | 2–25% | 3–25% |
| (c) | Family of fatty acids and rosin acids and/or naphthenic acids such as oleic, linoleic, linolenic, lauric, caprylic, abietic, fatty acid or mixtures thereof with the general formula $C_nH_{2n}O_2$ as in paragraph (b) above; | 5–75% | 10–50% |
| (d) | Organo metallic salts such as caproate, naphthenate, resinate, octoate, oleate, azeliate of copper, zinc, manganese, cobalt, calcium, zirconium and cerium and other compounds those skilled in the art would know as dryers. Lead, mercury and chromium are not preferred because of the toxic nature of the compounds; | .001–20% | .01–15% |
| (e) | Polyoxyethylene fatty acid esters | | |
| (f) | ethers as in the Type I component described in paragraph (e) | .5–25 | 1–20% |
| (5) | Polyoxyethylene ethers of sugars and sugar derived polyhydric alcohols as in the Type I components described in paragraph (e) | .5–25% | 1–20% |

The components as given in the table above are the essential components of the Type II composition. Other typical additives for a lubricant may be included for enhanced detergency, lubricity, improvement of the viscosity index and for cool operation of the engine.

The following components, for instance, are usefully optionally added:

| | | |
|---|---|---|
| High molecular weight alcohols such as octyl, isooctyl, lauryl, cetyl, steryl, oleyl, polymityl, myristyl, caprylyl, tridecyl, dodecyl decyl having 6 to 20 carbon atoms | 0.5–20% | 1–20% |
| Colloidal graphite micronized | .0001–1% | .001–20% |
| Polymethyl siloxanes | .01–25% | .1–25% |
| Gylcols and/or glycerols | .5–50% | 1–40% |
| Fatty esters of sugars or sugar alcohols | 0.5–20% | 1–20% |

-continued typically sorbitol trioleate

The Type II composition is also formed by blending together the essential components selected in the quantity range given and form a liquid blend directly useful with or without optional components as a crankcase or gear lubricant.

It will be understood for each of the type compositions I or II that water may be added in small emulsifiable quantity and on the other hand it may be substantially diluted with gasoline, in the quantity range stated. Each of the components Type I or Type II compositions are biodegradable; and water and mineral oil or either of them may be added in the quantity stated optionally for either composition. It is usually economically desirable at least in the Type II composition to include mineral oil. However, the degree of oil pollution will be proportional to the quantity of mineral oil used and will generally be reduced by the quantity of mineral oil replaced by the present composition.

These compositions perform two primary functions and are designed to eliminate oil pollution by internal combustion engines in air, on land and water:

1. eliminating oil, thereby eliminating oil pollution by internal combustion engines and their gear and transmission assemblies; and
2. lubricating internal combustion engines and their gear and transmission assemblies.

Type I compositions are to be added to a liquid hydrocarbon combustion fuel in varying proportions to a two or four-cycle internal combustion engine.

Type II compositions are to be added directly to the crankcase of a four-cycle internal combustion engine. Type II compositions are also to be added directly to gear and transmission assemblies which are integral parts of two-cycle and four-cycle internal combustion engines. Type II compositions may be added to oil and when added to oil in any proportioned amounts perform the function of lubrication but reduce the first function of eliminating oil pollution in direct proportion to the amount of oil needed.

The following specific examples illustrate the practice of this invention.

The following product was composited and then tested as a typical I composition:

EXAMPLE I 30 parts by weight of anhydrous ethyl alcohol
25 parts by weight of a mixture of oleic acid and linoleic acid in equal parts
8 parts by weight of triethanolamine
14.5 parts by weight of sorbitan trioleate
12 parts by weight of monopolyoxyethylene sorbitol pentaoleate in which the polyoxyethylene component had 32 oxyethylene groups.
10.25 parts by weight of deionized $H_2O$
0.25 part by weight of colloidal graphite micronized.

The product was formed by mixing the components in the stated quantities in a mixing tank for 30 minutes to form a homogeneous suspension.

A 500 cc. two-cycle outboard motor was mounted on a 200 gallon tank with recirculating water for cooling purposes to substantiate the feasibility of this Type I composition used with liquid hydrocarbon combustion fuel. The composition was tested with varying amounts of oil and by itself in varying amounts of the hydrocarbon fuel (gasoline). Tests were run at various speeds from 500 rpm to 4850 rpm for approximately 120 hours. The tests concluded absolute feasibility of the Type I composition by itself and with an oil, used as an upper cylinder lubricant in gasoline. A four-cycle engine was tested under the same conditions as the two-cycle engine and with the same test results. This Type I composition was used with gasoline in proportions from 1 part to 250 parts gasoline to 1 part to 10 parts gasoline for two-cycle engines. This composition was used with gasoline in proportions from 1 part to 100 parts of gasoline to 1 part to 100,000 parts gasoline for the four-cycle engine.

The following composition was similarly tested as in Example I and found to be equally satisfactory:

EXAMPLE II 40 parts by weight of acetone
20 parts by weight of naphthenic acid
6.5 parts by weight of triethanolamine
5 parts by weight of castor oil
14.5 parts by weight of sorbitan tristearate
9 parts by weight of water
0.5 part by weight of colloidal graphite micronized
4.5 parts by weight of a polyalkylene glycol having a molecular weight of about 800 with a viscosity at 100°F Sayboldt Universal seconds 250.

EXAMPLE III

A Type II composition having the following components was formed:

49.50 parts by weight of sodium rosinate
9 parts by weight of triethanolamine
33 parts by weight of oleic acid and abietic acid in equal parts
0.5 parts by weight of copper naphthenate
7.25 parts by weight of sorbitan trioleate
0.25 part by weight of dodecyl alcohol
0.5 part by weight of micronized graphite A 500 cc. two-cycle outboard motor was mounted on a 200 gallon tank with recirculating water for cooling purposes to substantiate the feasibility of this Type II composition used in the gear and transmission assembly. The composition was tested by itself and with varying proportions of oil in the gear and transmission assembly. The tests were run at various speeds from 500 rpm to 4850 rpm for approximately 120 hours. The composition was used by itself and mixed in varying proportions with oil used as a lubricant. A four-cycle engine was also tested under the same conditions as the two-cycle engine and with the same test results.

This composition was found alone to be suitable lubricant in both two and four-cycle gear, transmission and crankcase assemblies. It can be used with mineral oil from 1 part in 1 part to 1 part in 100 parts oil in the two-cycle and four-cycle gear and transmission assemblies and the four-cycle crankcase. The Type II compositions were also used by themselves in the two and four-cycle gear and transmission assemblies and in the four-cycle crankcase. This Type II composition when added to oil in any amounts such as 25 to 75 volume percent was tested to determine the feasibility and effectiveness as a lubricant and reducer of oil pollution in air, on land and water when used in two and four-cycle engines and in their gear and transmission assemblies. This, however, does not eliminate their usage in other systems and in other proportions. The addition of mineral oil to this Type II composition is not necessary to the effectiveness of this product. Any combination of oil and this composition can be used as a lubricant but the effectiveness is necessarily reduced as used to eliminate oil pollution in direct proportion to the amount of oil added.

EXAMPLE IV

The following composition was similarly tested under the conditions recited in Example III and was found to be an effective lubricant. It is an equally good lubricant further mixed with equal parts of mineral oil.

42 parts by weight of potassium linoleate
6.5 parts by weight of diethanolamine
22 parts by weight of lauric acid
2 parts by weight of copper octoate
12 parts by weight of polyoxyethylene sorbitan monooleate
4.5 parts by weight of isooctyl alcohol
1 part by weight of micronized graphite
5 parts by weight of linear methylsiloxane polymer
5 parts by weight of glycol Certain modifications will occur to those skilled in the art. Accordingly, it is intended that the description and examples given hereinabove will be regarded as illustrative and not limiting except as defined in the claims appended hereto.

What is claimed is:

1. A hydrocarbon oil-miscible and water-miscible, biodegradable lubricant composition consisting of biodegradable components consisting of at least two members selected from the group of (a) (b) and (c) components;

a. higher carboxylic acids having from 6 to 30 carbon atoms selected from the group consisting of fatty acids, rosin acids, naphthenic acids and tall oil acids in quantity of 5 to 75% by weight;

b. a member selected from the group consisting of lower alkyl amines, lower alkanol amines and hydrocarbyl monocarbocyclic primary amines, said lower alkyl amines and lower alkanol amines having 1 to 6 carbon atoms; said lower alkyl amines being primary, secondary or tertiary alkyl, in quantity of 2 to 25% by weight;

c. soaps of said higher carboxylic acids having a cation selected from the group consisting of ammonium and amine cations, said amine cation being derived from an amine selected from the group consisting of lower alkyl amines, lower alkanol amines and hydrocarbyl monocarbocyclic primary amines, said lower alkyl amines and lower alkanol amines having 1 to 6 carbon atoms, said lower alkyl amines being primary, secondary or tertiary alkyl, said soaps in quantity of 5 to 75% by weight; and in addition at least one each of the (d) (e) and (f) components d. polyloweralkyleneoxy esters of higher carboxylic acids having from 6 to 30 carbon atoms selected from the group consisting of fatty acids, rosin acids, naphthenic acids and tall oil acids, the lower alkylene group having 2 or 3 carbon atoms, the polyalkyleneoxy groups, in quantity of 0.5 to 25% by weight;

e. polyloweralkyleneoxy esters or ethers of polyhydric alcohols, sugars or sugar acids having at least 6 carbon atoms and 6 hydroxy groups, the lower alkylene group having 2 to 3 carbon atoms, in quantity of 0.5 to 25% by weight; and f. at least 20% by weight of a water-miscible solvent selected from the group consisting of lower alkanols, lower alkyl ketones and a lower polyhydric alcohol having 2 to 4 carbon atoms, said lubricant composition being blended with gasoline as an upper lubricant in quantity between about 0.1 gallon and 5,500 gallons of said lubricant per one thousand barrels of gasolines; said soaps and polyloweralkyleneoxy esters and ethers being present in quantity sufficient to render said composition miscible or emulsifiable in said gasoline.

2. The composition as defined in claim 1 and further including 0.1 to 40% of water; .0001 to 1% micronized graphite; 0.5 to 50% by weight of polyalkylene glycol containing 100 to 500 polyloweralkyleneoxy groups, the alkylene having 2 to 3 carbon atoms; 0.5 to 20% of a nondrying glyceride oil; and 0.5 to 20% of a higher fatty acid ester of a sugar derived alcohol selected from the group consisting of polyhydric alcohol and sugars having at least 6 carbon atoms and 6 hydroxy groups, all quantities being by weight.

3. A motor fuel composition containing, per one thousand barrels of gasoline, 0.1 to 5,500 gallons of the biodegradable composition consisting essentially of a. a diluent selected from the group consisting of lower alkyl ketones, and lowr monohydric alcohols having 1 to 4 carbon atoms in quantity of 20 to 75% by weight;

b. a higher carboxylic acid having 6 to 30 carbon atoms selected from the group consisting of saturated and unsaturated fatty acids, rosin acids, naphthenic acids and tall oil acid in quantity of 10 to 50% by weight;

c. a member selected from the group consisting of lower alkyl amines, lower alkanol amines and hydrocarbyl monocarbocyclic, primary amines said lower alkyl amines and lower alkanol amines having 1 to 6 carbon atoms, said lower alkyl amines being primary, secondary or tertiary alkyl in quantity of 3 to 25% by weight;

d. polyloweralkyleneoxy fatty acid esters in which the lower alkylene has 2 to 3 carbon atoms and the fatty acid has 6 to 30 carbon atoms, and having from 10 to 60 alkyleneoxy groups in quantity of 0.5 to 25% by weight; and e. polyoxyloweralkylene esters or ethers of polyhydric alcohols, sugars or sugar acids having at least 6 carbon atoms and 6 hydroxy groups in which the lower alkylene has 2 to 3 carbon atoms and having from 10 to 60 alkyleneoxy groups in quantity of 0.5 to 25%, said percentages being by weight.

4. The composition as defined in claim 3 wherein the group (a) component is present in quantity ranging from 30 to 60%; the group (b) component is present in quantity ranging from 20 to 40%; the group (c) component is present in quantity ranging from 7 to 20%; the group (d) component is present in quantity ranging from 1 to 20%; and the group (e) component is present in quantity ranging from 1 to 20%; all quantities being by weight.

5. The composition as defined in claim 3 further containing 0.1 to 40% by weight of water.

6. The composition as defined in claim 3 further containing 0.0001 to 1% by weight of micronized graphite.

7. The composition as defined in claim 3 further containing 0.5 to 50% by weight of a polyalkylene glycol containing 100 to 500 polyloweralkyleneoxy groups, the alkylene having 2 to 3 carbon atoms.

8. The composition as defined in claim 3 further containing a non-drying glyceride oil in quantity ranging from 0.5 to 20% by weight.

9. The lubricant composition for use as a gear, transmission and crankcase lubricant, said composition comprising a. 5 to 75 weight percent of alkali metal, alkaline earth metal, ammonium or amine soaps of higher carboxylic acids having 6 to 30 carbon atoms selected from the group consisting of saturated fatty acids, unsaturated fatty acids, rosin acids, naphthenic acids and tall oil acids, said amine selected from the group consisting of lower alkyl amines of 1 to 6 carbon atoms, lower alkanol amines of 1 to 6 carbon atoms and lower hydrocarbyl monocarbocyclic amines;

b. an amine selected from the group consisting of lower alkyl of 1 to 6 carbon atoms, lower alkanol amines of 1 to 6 carbon atoms and hydrocarbyl monocarbocyclic amines in quantity of 2 to 25%;

c. higher carboxylic acids having 6 to 30 carbon atoms selected from the group consisting of saturated fatty acids, unsaturated fatty acids, rosin acids, naphthenic acids and tall oil acids in quantity of 5 to 75%;

d. heavy metal soaps of the carboxylic acids of group (c), the metal being selected from the group consisting of zinc, manganese, copper, cobalt, zirconium and cerium ranging in quantity from 0.001 to 20%;

e. polyoxyalkylene higher carboxylic acid esters or ethers, the acid being selected from the group consisting of saturated and unsaturated naphthenic acids, rosin acids, tall oil acids and fatty acids having from 6 to 30 carbon atoms, the polyoxyalkylene having from 10 to 60 polyloweralkyleneoxy groups in which the alkylene has 2 to 3 carbon atoms in quantity of 0.5 to 25% in which the percentage quantities are by weight;

f. polyoxyloweralkylene esters or ethers of polyhydric alcohols, sugars or sugar acids having at least 6 carbon atoms and 6 hydroxy groups in which the lower alkylene has 2 to 3 carbon atoms, and having from 10 to 60 alkyleneoxy groups in quantity of 0.5 to 25%, said percentages being by weight.

10. The composition as defined in claim 9 wherein the group (a) component is present in quantity ranging from 10 to 60%; the group (b) component is present in quantity ranging from 3 to 25%; the group (c) component is present in quantity ranging from 10 to 50%; the group (d) component is present in quantity ranging from 0.1 to 15%; and the group (e) component is present in quantity ranging from 1 to 20%, the percentage quantities being by weight.

11. The composition as defined in claim 9 blended with from 1 to 100 parts by weight of a hydrocarbon mineral lubricating oil.

12. The composition as defined in claim 10 blended with from 1 to 100 parts by weight of a hydrocarbon mineral lubricating oil.

13. The composition as defined in claim 9 further containing 0.5 to 20% by weight of higher fatty alcohol having from 6 to 20 carbon atoms.

14. The composition as defined in claim 9 further containing from .0001 to 1% by weight of micronized graphite.

15. The composition as defined in claim 9 further containing 0.1 to 25% by weight of polymethyl siloxane.

16. The composition as defined in claim 9 wherein the composition further contains from 0.5 to 50% by weight of a polyhydric alcohol of the group consisting of ethylene glycol and glycerol.

17. The composition as defined in claim 3 comprising ethyl alcohol in quantity of 30 to 60%; unsaturated higher fatty acid in quantity of 20 to 40%; triethanolamine in quantity of 7 to 20%; sorbitan trioleate in quantity of 1 to 20%; polyoxyethylene sorbital hexaoleate in quantity of 1 to 20%; deionized water in quantity of 5 to 25%; and micronized graphite in quantity of 0.001 to 0.5%, the percentages being by weight.

18. The composition as defined in claim 3 comprising acetone in quantity of 30 to 60%; naphthenic acid in quantity of 20 to 40%; triethanolamine in quantity of 7 to 20%; Castor oil in quantity of 1 to 20%; sorbitan tristearate in quantity of 1 to 20%; polyoxyethylene stearate in quantity of 1 to 20%; water in quantity of 5 to 25%; micronized graphite in quantity of .001 to .05; and polyethylene glycol in quantity of 1 to 40%; the percentage quantities being by weight.

19. The composition as defined in claim 9 comprising sodium resinate in quantity of 10 to 60%; triethanolamine in quantity of 3 to 25%; mixed unsaturated fatty and rosin acids in about equal proportions in quantity of 10 to 50%; copper naphthenate in quantity of 0.1 to 15%; sorbitan trioleate in quantity of 1 to 20%; dodecyl alcohol in quantity of 1 to 20%; and micronized graphite in quantity of .001 to 1%, the percentage quantities being by weight.

20. The composition as defined in claim 9 comprising potassium linoleate in quantity of 10 to 60%; diethanolamine in quantity of 3 to 25%; lauric acid quantity of 10 to 50%; copper octoate in quantity of 0.1 to 15%; polyoxyethylene sorbitan monooleate having about fifty polyoxyethylene groups in quantity of 0.1 to 50%; micronized graphite in quantity of .001 to about 1%; polymethylsiloxane having a molecular weight of about 5000 in quantity of 0.1 to 10%; and glycol in quantity of 1 to 10%, the percentage quantities being by weight.

21. Gasoline containing an upper cylinder lubricant as defined in claim 1, said lubricant composition being blended as an upper lubricant in quantity from one part of lubricant to two hundred fifty parts of gasoline for a two-cycle engine or a concentrated liquid fuel composition and from one part of lubricant to one thousand to one hundred thousand parts of gasoline for a four-cycle engine.

22. The motor fuel as defined in claim 3 wherein the motor fuel composition contains from one part of lubricant to from ten to two hundred fifty parts of gasoline for a two-cycle engine or as a concentrated composition, and from one part of lubricant to one thousand to one hundred thousand parts of gasoline for a four-cycle engine.

* * * * *